United States Patent [19]

Nelson

[11] Patent Number: 4,519,480

[45] Date of Patent: May 28, 1985

[54] BRAKE LEVER RETAINING BRACKET

[75] Inventor: Thomas A. Nelson, Munster, Ind.

[73] Assignee: Hadady Corporation, Lansing, Ill.

[21] Appl. No.: 481,295

[22] Filed: Apr. 1, 1983

[51] Int. Cl.[3] ..... B61H 13/38

[52] U.S. Cl. ..... 188/52; 188/195; 188/210; 188/222.6; 248/544

[58] Field of Search ..... 188/33, 52, 53, 54, 188/55, 107, 153 R, 153 A, 153 D, 195, 207, 188/209, 210, 222.6, 229.1, 231, 232, 233; 105/168, 105/182 R; 248/544

[56] References Cited

U.S. PATENT DOCUMENTS

| | | | |
|---|---|---|---|
| 1,725,922 | 8/1929 | Johnson | 188/209 |
| 1,988,235 | 1/1935 | Busch | 188/210 |
| 2,253,199 | 8/1941 | Sabold | 188/153 A |
| 2,873,823 | 2/1959 | Couch | 188/209 |
| 3,207,271 | 9/1965 | Polanin et al. | 188/195 |
| 3,448,837 | 6/1969 | Casey | 188/210 |

FOREIGN PATENT DOCUMENTS

| | | | |
|---|---|---|---|
| 538931 | 1/1977 | U.S.S.R. | 188/52 |

*Primary Examiner*—Douglas C. Butler
*Assistant Examiner*—Richard R. Diefendorf
*Attorney, Agent, or Firm*—Cook, Wetzel & Egan, Ltd.

[57] ABSTRACT

A lightweight, brake lever-retaining bracket which includes two arms, each of which is equipped with a stiffener to provide extended bearing surfaces for brake lever mounting pins, and a safety platform to prevent loss of brake levers in the event of brake lever retaining pin failure. A safety bolt adjustably connects both arms to minimize lateral movement of the brake lever and to maintain the brake lever in operative position in the event of retaining pin failure.

2 Claims, 5 Drawing Figures

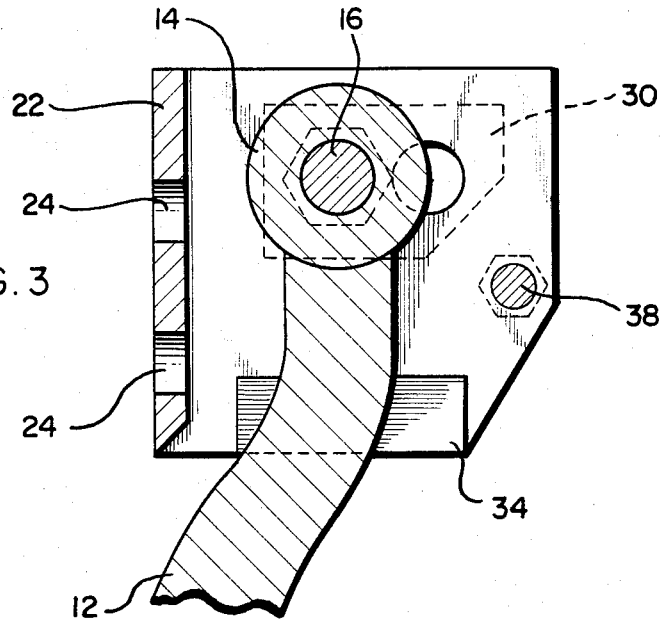
FIG. 3
FIG. 4
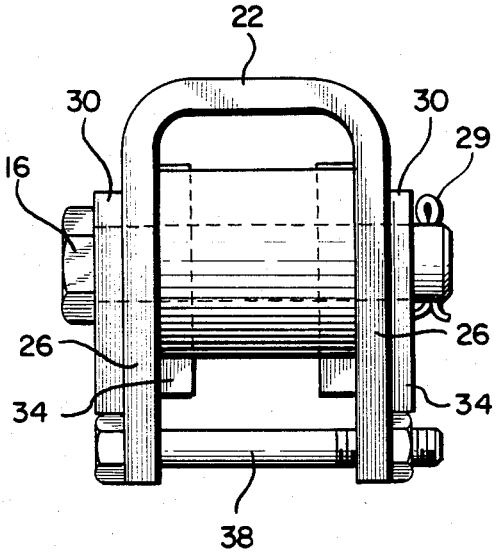
FIG. 5
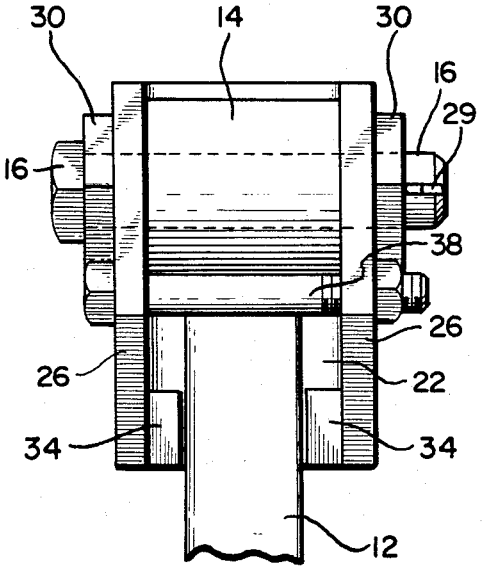

BRAKE LEVER RETAINING BRACKET

The present invention is directed to an improved brake lever retaining bracket which is used in connection with railway car tread brake rigging of the self aligning type, wherein a freight car truck comprises side frames supported at their ends upon wheel and axle assemblies, with a bolster resiliently supported at its ends and adapted for vertical movement upon spring groups seated on the side frames, and having brake beams operated by power cylinders suspended by brake levers which are attached to the bolster by brackets. The brake lever retaining brackets of the present invention may be fabricated from relatively light weight materials, thus reducing the overall weight of the brake system. Moreover, the brackets of the present invention include features which prevent the brake cylinders from dropping onto the railroad track in the event the brake lever pins are removed or otherwise fail. Finally, brackets of the present invention limit the lateral movement of the brake levers, and thereby assure that the brake shoes will be aligned with the wheels and that the thrust of the brake cylinder is aligned with the intended portions of the brake beam. The advantages contemplated by the present invention accomplish the safety provisions of other prior art devices, but with a much lighter weight equipment required to carry out the same safety function.

THE PRIOR ART

Tread brake rigging arrangements for self-aligning sprung railway freight car trucks are well known and have been in use for a substantial number of years. Moreover, brake systems wherein the brake cylinder is suspended from a pair of brake levers, the upper end of which is attached to a bolster through a bracket, is also known in the art—see for example U.S. Pat. No. 3,207,271 to Polanin, et al.

Such prior art brake assemblies, however, encounter problems in the event the upper end of the brake lever comes disconnected, because the braking system is not only disabled, but the end of the brake cylinder may hang beneath the truck where it is subject to striking the track, ties or ballast wherein the cylinder is damaged or lost. The prior art, aware of this problem, has proposed a number of safety devices which involved securing the brake cylinder to the bolster by a variety of mechanisms, all of which are cumbersome, heavy and interfere with any maintenance that might be required on the brake system or the brake cylinder in particular.

BRIEF DESCRIPTION OF THE INVENTION

The brake lever retaining brackets of the present invention are light weight brackets with provision for extended bearing surfaces for the brake lever mounting pins, safety platforms to prevent loss of brake levers in the event of brake lever retaining pin failure and a safety bolt which maintains the brake lever in an operative position in the event of retaining pin failure.

The present invention provides an improved bracket which not only reduces or eliminates the problem of lateral sway of the brake cylinder during movement of the railroad truck, but which prevents the brake cylinder from dropping or falling off the truck in the event the brake lever retaining pin fails or is accidently removed.

The operation of the improved brake lever bracket will be understood by reference to the drawings in which:

FIG. 3 is a side view of the brake lever retaining bracket with the brake lever mounted therein;

FIG. 4 is a top view of the brake lever retaining bracket with the brake lever mounted therein; and FIG. 5 is a front view of the brake lever retaining bracket with the brake lever mounted therein.

Figure 1:
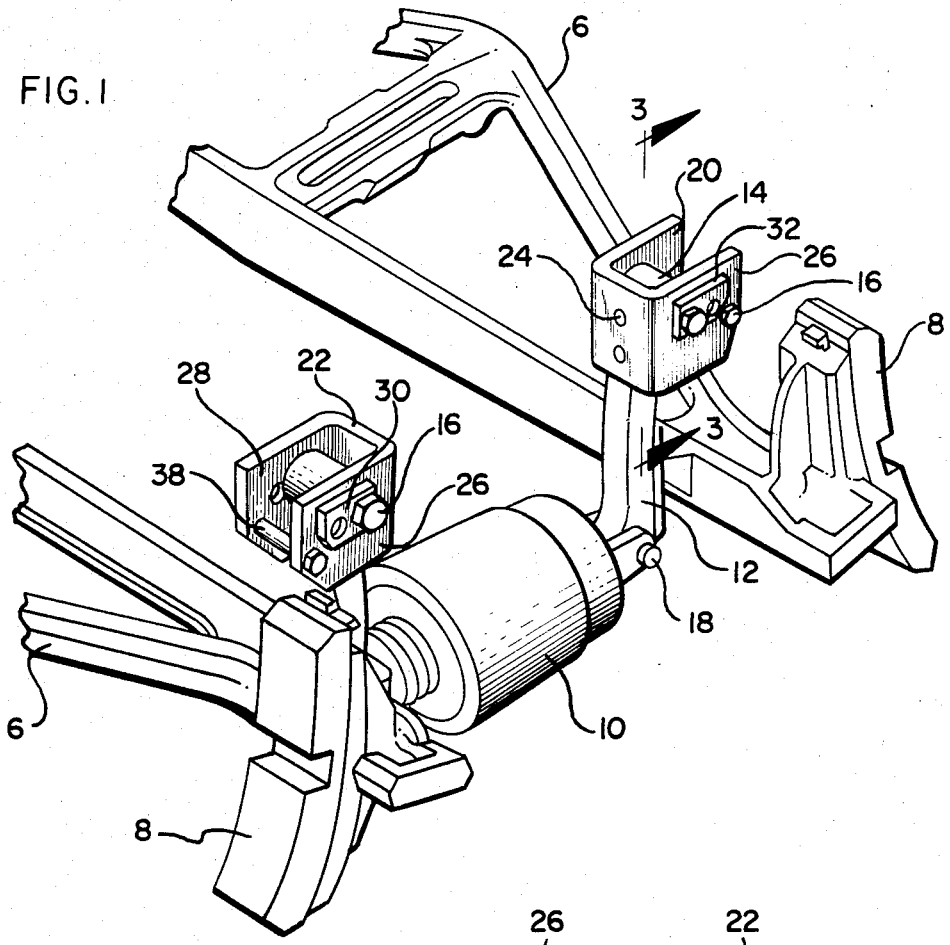
FIG. 1 is an isometric view of a portion of a brake rigging showing two of the brake lever retaining brackets in the environment in which they would be used.
Figure 2:
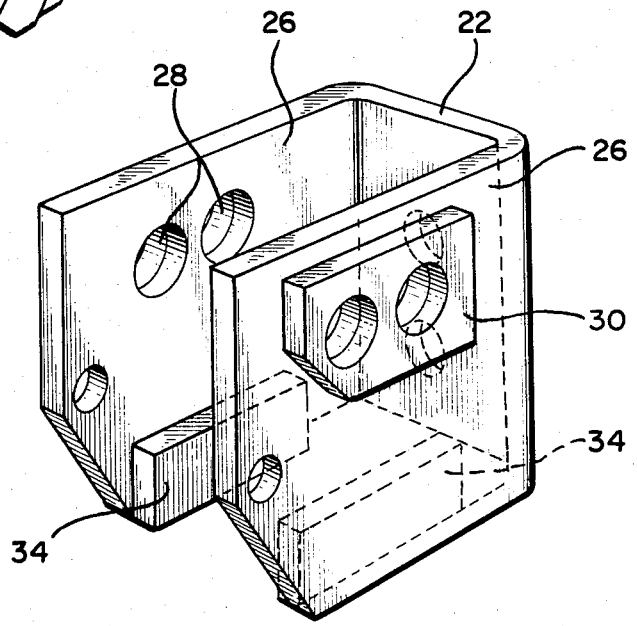
FIG. 2 is a isometric view of the brake lever retaining bracket.

Having reference to the drawings for a better understanding of the invention, a conventional truck-mounted tread brake rigging is shown in FIG. 1, as applied to a conventional four wheel freight car truck. Some components have been omitted for simplifying the illustrations presented herein. In FIG. 1, brake beams 6 are connected to brake shoes 8 which are adapted to bear against wheels, not shown. The brake beams 6 are powered by brake cylinder 10 which is mounted between the brake beams 6 and suspended at the lower end of brake levers 12 through brake cylinder retaining pin 18. The upper end or head 14 of brake lever 12 is mounted in bracket 20 where it is held by the brake lever retaining pin 16. Bracket 20 is bolted to the bolster, not shown. Thus the brake cylinder 10 is suspended from the bolster. As the springs, not shown, of the truck are compressed, and the bolster moves vertically, the amount of force applied to the brake shoe 8 by the brake cylinder 10 through brake beam 6 will vary proportionately to the spring deflection, and thus the amount of force applied to the wheels by brake shoes 8 will be variable and dependent upon the loading of the car.

The details of the brake lever bracket are more readily seen from FIGS. 2 through 5, wherein the bracket 20 comprises base member 22 which includes two horizontally extending arms 26. The base member 22 is provided with mounting holes, adapted to secure the bracket 20 to the bolster.

Each of the arms is provided with one or more openings 28 adapted to receive the brake lever retaining pin 16. As is shown in FIGS. 4 and 5, the head 14 of brake lever 12 fits into bracket 20, and brake lever retaining pin 16 engages the opening in the head 14 of brake lever 12. Pin 16 extends through both arms 26 and is preferably held in place by a cotter pin 29 or other similar retaining structure.

Each arm 26 is equipped with a stiffening member 30 in the area surrounding opening 28. The stiffener 30 is preferably welded to arm 26. The stiffening member 30 is provided with one or more openings 28, coaxial with the openings 28 in arm members 26, in order to receive brake lever retaining pin 16. Stiffener member 30 cooperates with arm 26 to provide an extended bearing surface, through the coaxially aligned opening 28, for pin 16. The extended bearing surface provided by stiffener member 30 improves the life expectancy of the bracket through the mechanism of providing a larger bearing surface. The extended bearing surface provided by the combination of arm 26 and stiffener member 30 is at least as great as that provided by the prior art castings, but at a weight substantially reduced from the prior art castings.

The brake lever retaining bracket of the present invention also includes a pair of safety platforms 34 affixed to inner side of arms 26. Safety platforms 34, which are preferably welded to arms 26, extend inwardly from arms 26 and beneath the head 14 of brake lever 12. The safety platforms 34 function as a stop to retain the brake lever 12, in the event brake lever retaining pin 16 is accidentally removed or fails.

Should the brake lever retaining pin 16 fail or be removed from the bracket, the weight of the brake cylinder and associated equipment, which would tend to cause the brake lever to fall from the bracket, will pull the head 14 of the brake lever 12 downwardly and out of alignment with opening 28, but the safety platforms 34 in the bracket of the present invention are adapted to engage the head 14 of the brake lever 12, and thus prevent the brake cylinder and its associated equipment from falling from the truck.

The safety platforms 34 also functions to limit lateral movement of brake lever 12. When the brake lever 12 is retained in bracket 20 by retaining pin 16, and the truck is moving, any lateral movement of the brake cylinder 10 is transmitted to the bracket 20 by brake lever 12. The movement of brake cylinder 10, when the truck is in motion may be great both in terms of the forces generated and the frequency of the motion, because of poor road beds, bad track and the like. Because of the length of brake lever 12, any motion of the brake cylinder 10 is amplilfied and is transmitted directly to the bracket 20, which motion tends to wear brake lever retaining pin 16 and the surfaces on which pin 16 bears, i.e., opening 28. As can be seen from FIG. 5, the safety platforms 34 which abut brake lever 12 limit the lateral motion of the brake lever 12 and thus curtail the torque and wear on pin 16 and bearing surface 28.

The primary purpose of safety bolt 38 is to hold head 14 of brake lever 12 within the bracket 20 in the event the brake lever retaining pin 16 is removed or fails. As can be seen in FIG. 3, if pin 16 is removed, the brake lever head 14 will fall and engage safety platform 34 wherein its longitudinal position is maintained between base member 22 and safety bolt 38 and the brake lever is maintained in an operable position.

The brake lever bracket of the present invention also includes safety bolt 38 which spans from one arm 26 to the other arm 26, near the extremity of the arms, also prevents the arms from separating or spreading apart. The possibility exists that lateral sway of the brake cylinder, which can generate considerable torque on the head of the brake lever, would tend to open the bracket, i.e., spread the arms apart. If carried to extreme, the cotter pin 29 could be sheared and the brake lever retaining pin could slip from its operative position, resulting in the brake lever falling from the bracket. This eventuality is precluded by the presence of safety bolt 38.

In the preferred embodiment, the brake lever mounting bracket 20 within the arms 26 includes a plurality of openings 28 in order to accommodate different levers or to function as wear take-up adjustments.

The brackets of the present invention may be made from relatively light weight stock. Although the prior art brake lever brackets have been cast or produced by welding arms to base such as base 22, using stock at least $\frac{3}{4}$ inch thick, the brackets of the present invention may be made out of $\frac{3}{8}$ inch stock and formed by bending, either before or after stiffeners 30 and safety platform 34 are welded into appropriated positions.

In the preferred embodiment the bracket is fabricated from C-1020 hot rolled plate—$\frac{3}{8}$" thick.

Those skilled in the art will understand that both brake lever retaining pin 16 and safety bolt 38 may be threaded to receive a nut, may be drilled to receive a cotter pin, or may be equipped with various other retaining means such as clips, snaps or horseshoe springs.

The forms of invention shown and described herein are to be considered only as illustrative. It will be apparent to those skilled in the art that numerous modifications may be made therein without departing from the spirit of the invention or the scope of the appended claims.

What is claimed is:

1. In a railroad tread brake rigging for a self aligning spring railway freight car truck, having side frames supported at their ends upon wheel and axle assemblies and a bolster resiliently supported at its ends for vertical movement upon spring groups seated on the side frames, and having brake power cylinders affixed to the lowermost end of brake levers connected to the bolster from brackets, the improvement comprising:

a lightweight brake lever retaining bracket comprising:

a base member adapted to be affixed to a bolster, two arms extending horizontally from said base, said arms adapted to receive the head of a brake lever, said arms having openings to receive a brake lever retaining pin, stiffener members affixed to each arm, said stiffener members having openings aligned with the openings coaxially in said arms and adapted to receive a brake lever retaining pin;

a safety bolt means connecting the extremities of said arms, and limiting the distance between the extremities of said arms, and safety platforms affixed to to the lowermost portion of said arms and extending inwardly, and limiting the lateral movement of said brake lever, said inwardly extending safety platforms adapted to engage the head of said brake lever in the event said retaining pin is removed or withdrawn.

2. In a railroad tread brake rigging as described in claim 1, wherein said stiffener members are affixed to the outer portions of said arms.

* * * * *